US006260960B1

(12) United States Patent
Hashizume et al.

(10) Patent No.: US 6,260,960 B1
(45) Date of Patent: Jul. 17, 2001

(54) INK JET PRINT HEAD FORMED THROUGH ANISOTROPIC WET AND DRY ETCHING

(75) Inventors: Tsutomu Hashizume; Tetsushi Takahashi, both of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 08/957,380

(22) Filed: Oct. 24, 1997

(30) Foreign Application Priority Data

| | | |
|---|---|---|
| Oct. 24, 1996 | (JP) | 8-282724 |
| Feb. 17, 1997 | (JP) | 9-032481 |
| Oct. 23, 1997 | (JP) | 9-291285 |

(51) Int. Cl.[7] ..... B41J 2/045
(52) U.S. Cl. ..... 347/70; 716/27
(58) Field of Search ..... 347/68–71, 64, 347/65; 216/27, 57; 438/21, 704

(56) References Cited

U.S. PATENT DOCUMENTS

| | | | | |
|---|---|---|---|---|
| 5,010,355 | * | 4/1991 | Hawkins et al. | 347/64 |
| 5,148,185 | * | 9/1992 | Abe et al. | 347/65 |
| 5,265,315 | | 11/1993 | Hoisington et al. | 29/25.35 |
| 5,277,755 | * | 1/1994 | O'Neill | 347/71 |
| 5,308,442 | | 5/1994 | Taub et al. | 156/644 |
| 5,354,419 | | 10/1994 | Hadimioglu | 156/644 |
| 5,371,529 | * | 12/1994 | Eguchi et al. | 347/7 |
| 5,802,686 | * | 9/1998 | Shimada et al. | 29/25.35 |
| 6,074,048 | * | 6/2000 | Hotomi et al. | 347/69 |

FOREIGN PATENT DOCUMENTS

| | | | |
|---|---|---|---|
| 0 600 382 | 6/1994 | (EP) | B41J/2/16 |
| 0 698 490 | 2/1996 | (EP) | B41J/2/045 |
| 0 716 925 | 6/1996 | (EP) | B41J/2/045 |
| 0 736 385 | 10/1996 | (EP) | B41J/2/045 |
| 0 738 599 | 10/1996 | (EP) | B41J/2/045 |
| WO 96/20503 | 7/1996 | (WO) | H01L/41/08 |

OTHER PUBLICATIONS

Patent Abstracts of Japan vol. 12, No. 493 (E–697) Dec. 22, 1988, & JP 63 205916 A (Nippon Denso Co Ltd) Aug. 25, 1988 *Abstract.

Patent Abstract of Japan vol. 8, No. 69, (M–286) Mar. 31, 1984, & JP 58 217368 A (Ricoh KK) Dec. 17, 1983 *Abstract.

Patent Abstracts of Japan vol. 98, No. 7, Mar. 31, 1998 & JP 04 355758 A (Samsung Electronics Co., Ltd.) Dec. 9, 1992 *Abstract.

Patent Abstracts of Japan vol. 96, No. 11, Nov. 29, 1996 & JP 08 191103 A (Nippondenso Co Ltd) Jul. 23, 1996 *Abstract.

Patent Abstracts of Japan vol. 7, No. 258 (E–211), Nov. 17, 1983 & JP 58 143535 A (Hitachi Seisakusho KK) Aug. 26, 1983 *Abstract.

Patent Abstracts of Japan vol. 12, No. 239 (E–630) Jul. 7, 1988, & JP 63 031172 A (NEC Corp) Feb. 9, 1998 *Abstract.

* cited by examiner

*Primary Examiner*—Benjamin R. Fuller
*Assistant Examiner*—C Dickens
(74) *Attorney, Agent, or Firm*—Sughrue, Mion, Zinn, Macpeak & Seas, PLLC

(57) ABSTRACT

An ink jet print head includes PZT films formed on a first surface of a single-crystal silicon substrate, ink cavities formed in the regions of the single-crystal silicon substrate which correspond in position to the PZT films, and a nozzle plate formed on a second surface of the single-crystal silicon substrate, which is opposite to the first surface. Each ink cavity is formed using anisotropical wet and dry etching, and wherein a portion of each ink cavity close to the first surface of the single-crystal silicon substrate is anisotropically dry etched.

16 Claims, 11 Drawing Sheets

FIG. 2 (1)
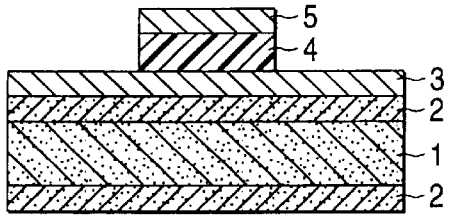
FIG. 2 (4)
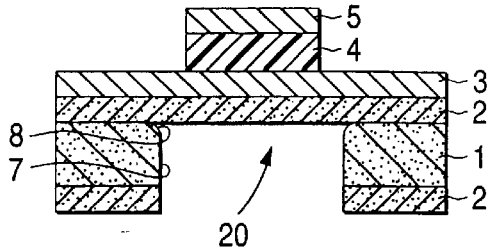
FIG. 2 (2)
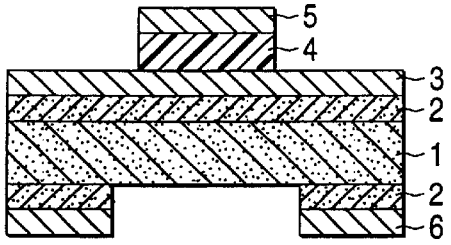
FIG. 2 (5)
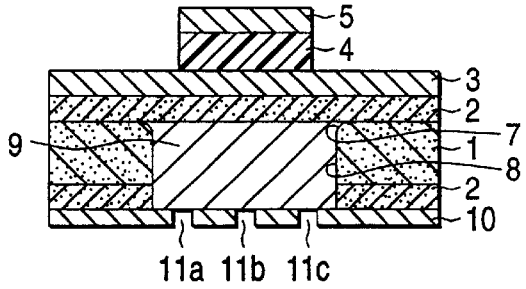
FIG. 2 (3)
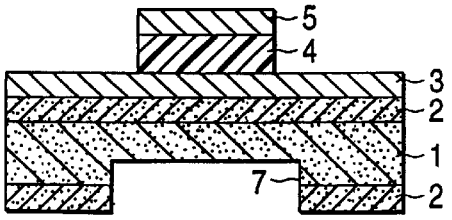
FIG. 2 (6)
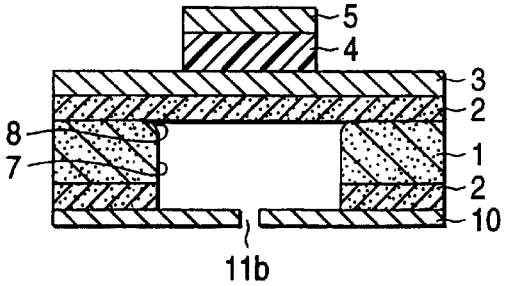

FIG. 7 (1)
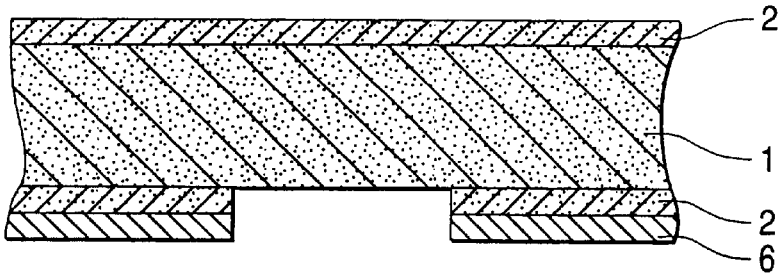
FIG. 7 (2)
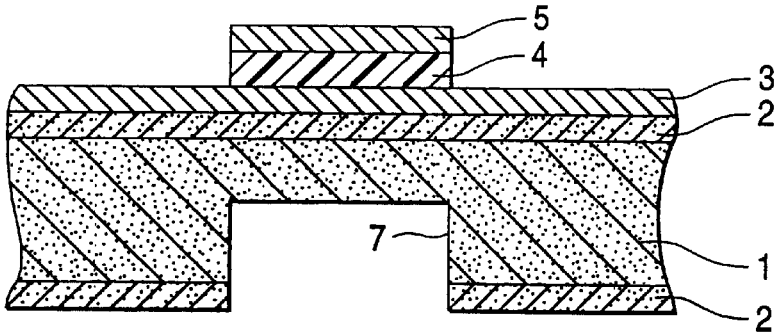
FIG. 7 (3)
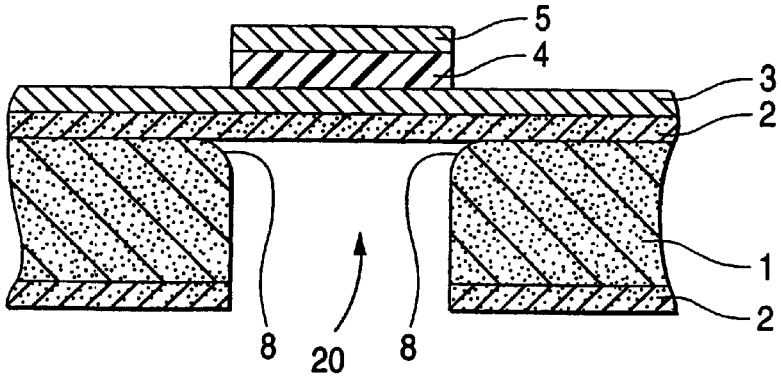

FIG. 8 (1)
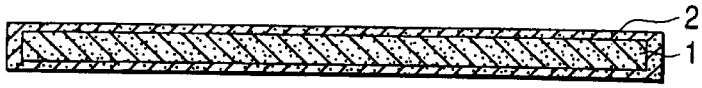
FIG. 8 (2)
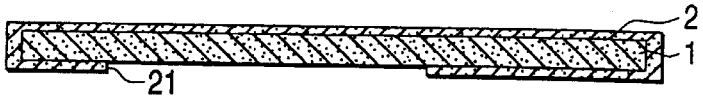
FIG. 8 (3)
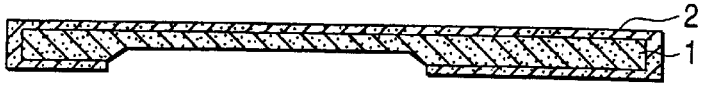
FIG. 8 (4)
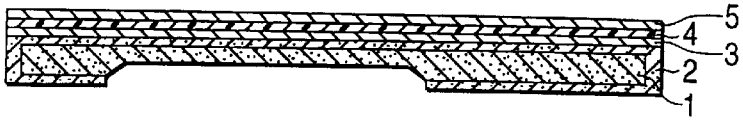
FIG. 8 (5)
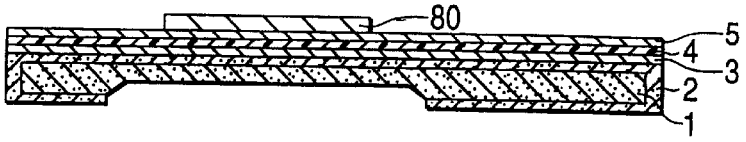
FIG. 8 (6)
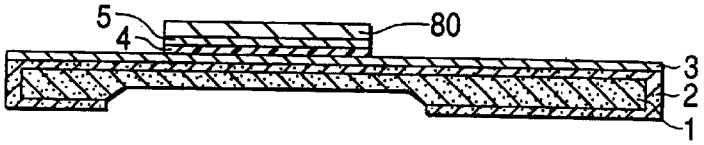
FIG. 8 (7)
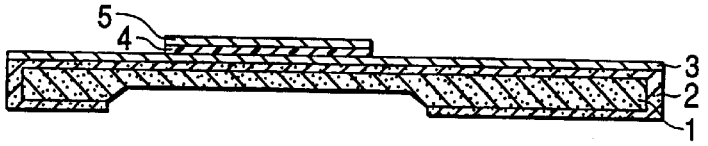
FIG. 8 (8)
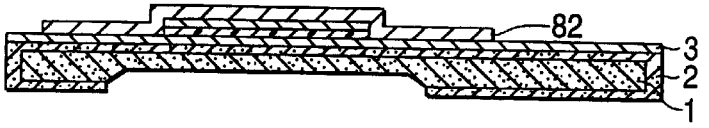
FIG. 8 (9)
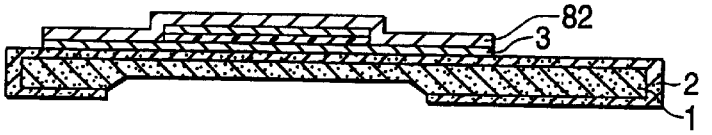
FIG. 8 (10)
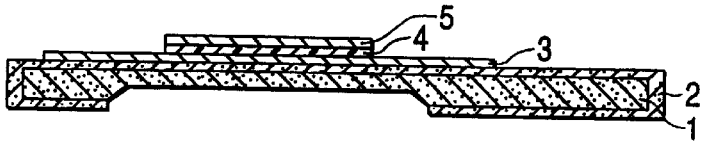
FIG. 8 (11)
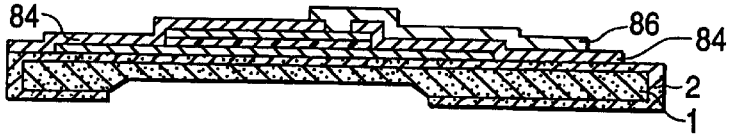
FIG. 8 (12)
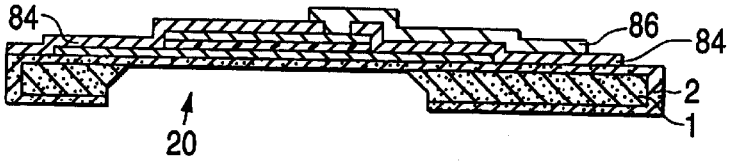

FIG. 9 (1)
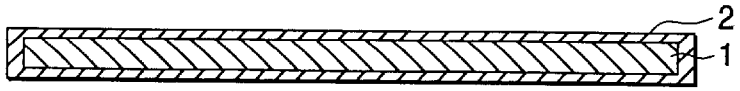
FIG. 9 (2)
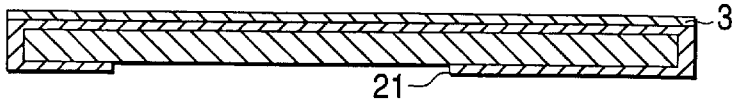
FIG. 9 (3)
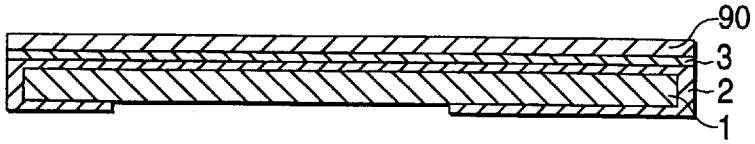
FIG. 9 (4)
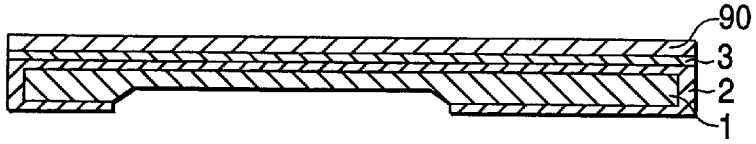
FIG. 9 (5)
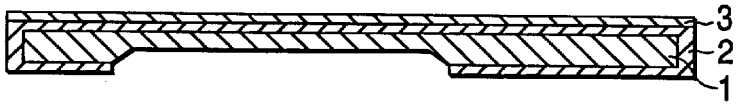
FIG. 9 (6)
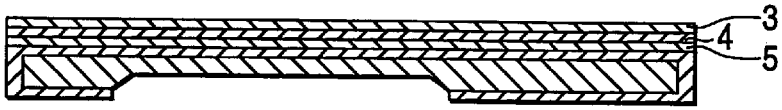

FIG. 10 (1)
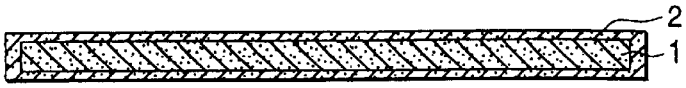
FIG. 10 (2)
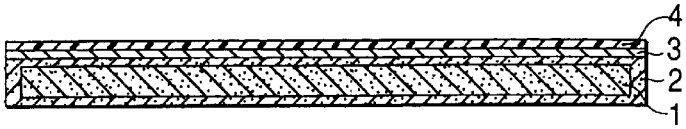
FIG. 10 (3)
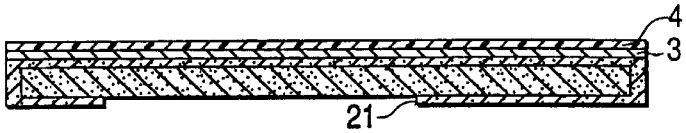
FIG. 10 (4)
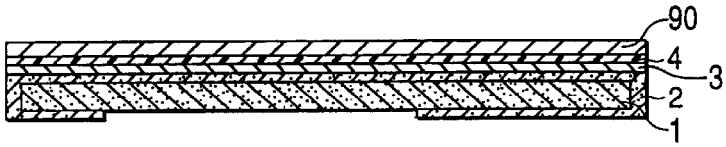
FIG. 10 (5)
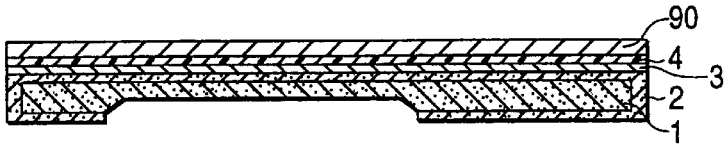
FIG. 10 (6)
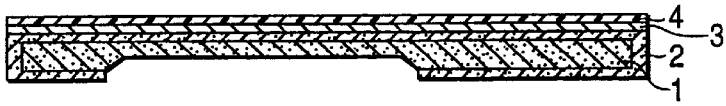
FIG. 11 (1)
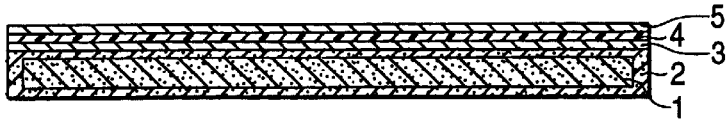
FIG. 11 (2)
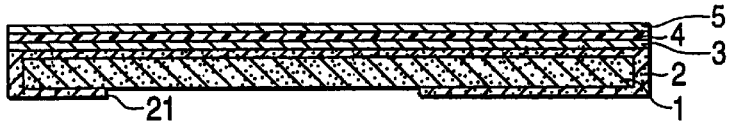
FIG. 11 (3)
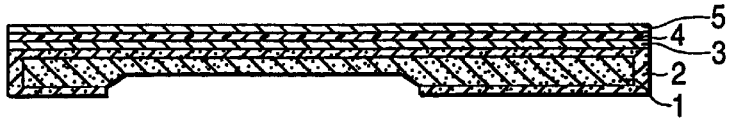

FIG. 12 (1)
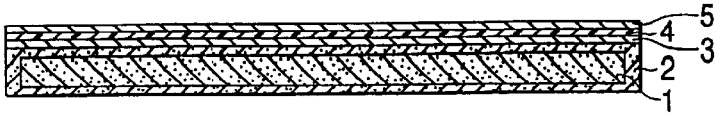
FIG. 12 (2)
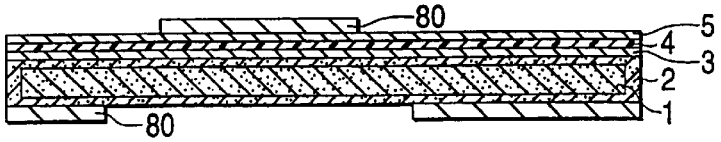
FIG. 12 (3)
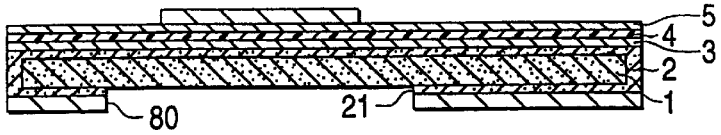
FIG. 12 (4)
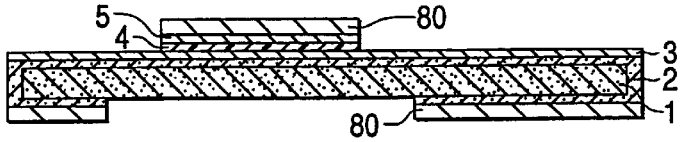
FIG. 12 (5)
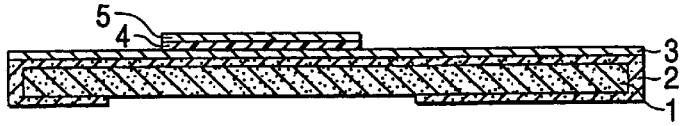
FIG. 12 (6)
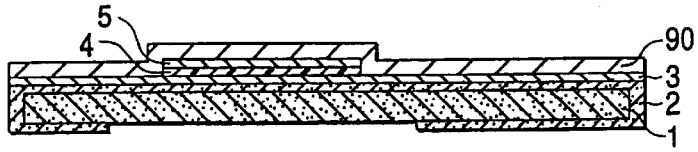
FIG. 12 (7)
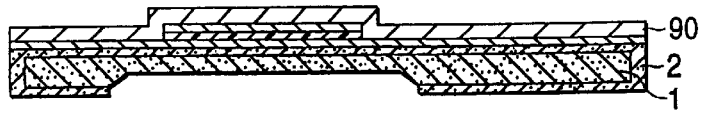
FIG. 12 (8)
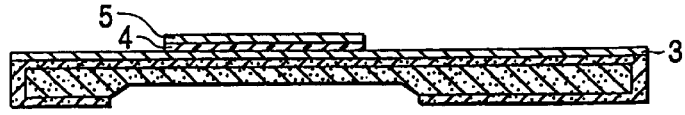

FIG. 13 (1)
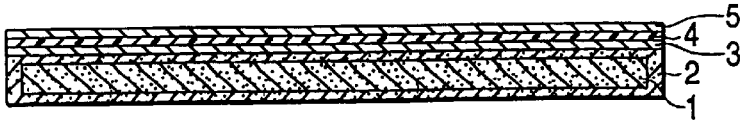
FIG. 13 (2)
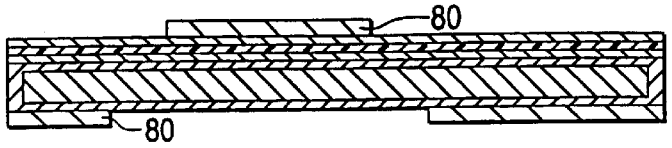
FIG. 13 (3)
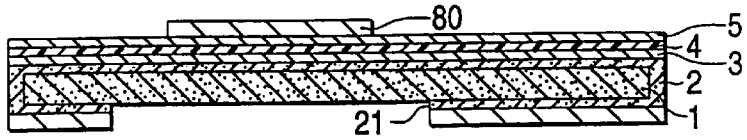
FIG. 13 (4)
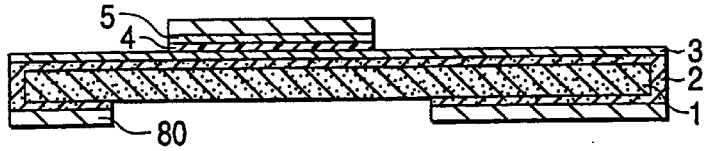
FIG. 13 (5)
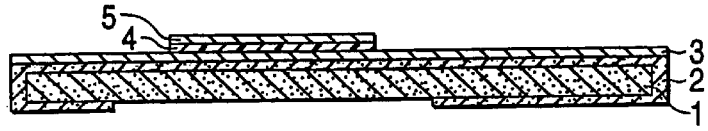
FIG. 13 (6)
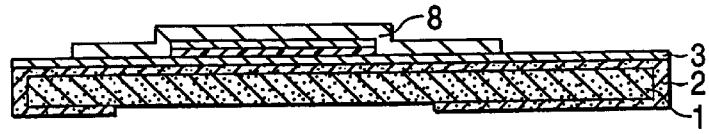
FIG. 13 (7)
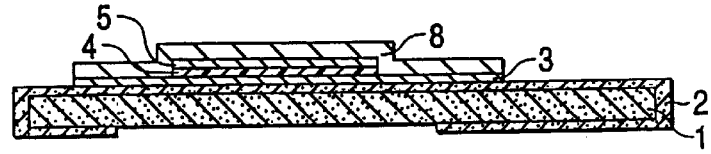
FIG. 13 (8)
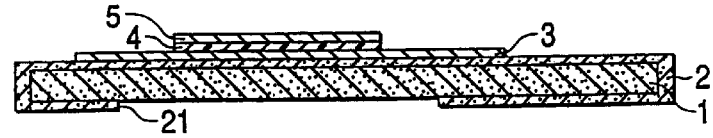
FIG. 13 (9)
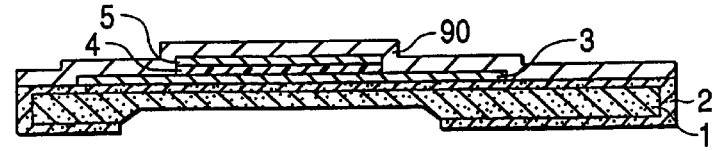
FIG. 13 (10)
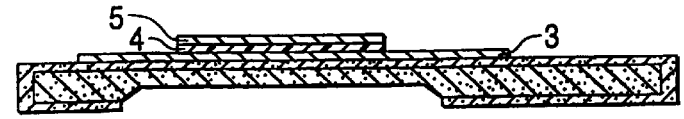

FIG. 14 (1)
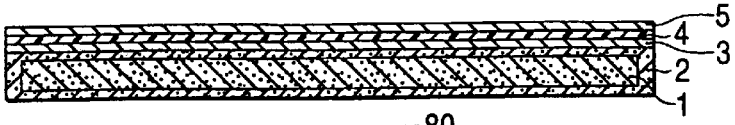
FIG. 14 (2)
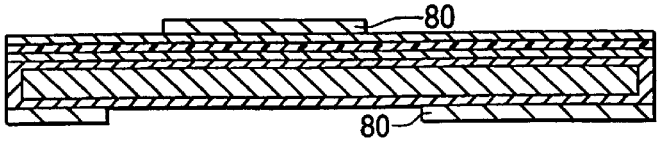
FIG. 14 (3)
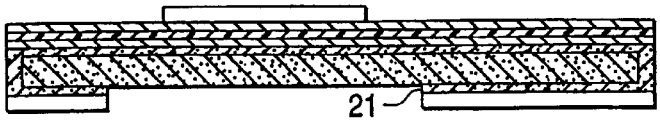
FIG. 14 (4)
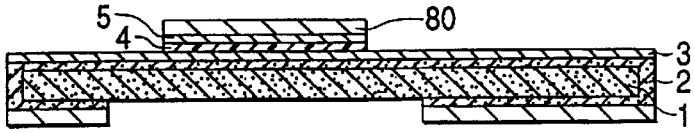
FIG. 14 (5)
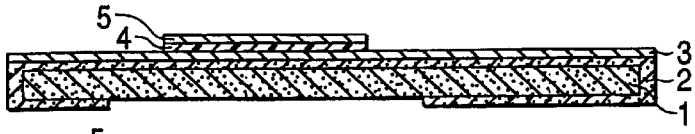
FIG. 14 (6)
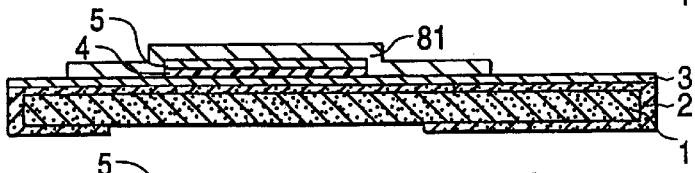
FIG. 14 (7)
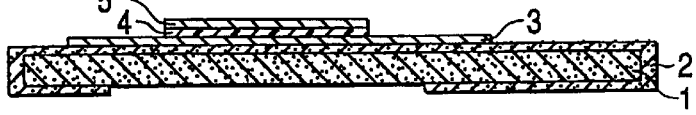
FIG. 14 (8)
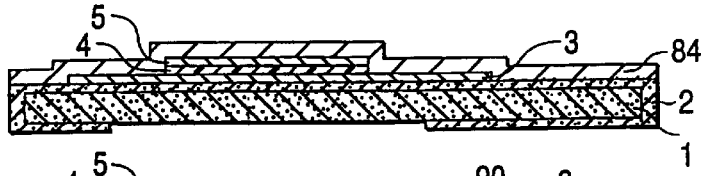
FIG. 14 (9)
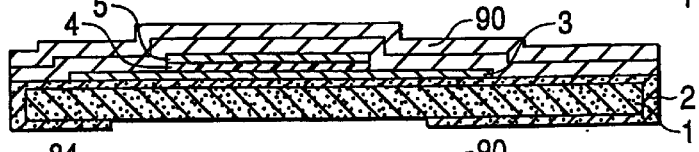
FIG. 14 (10)
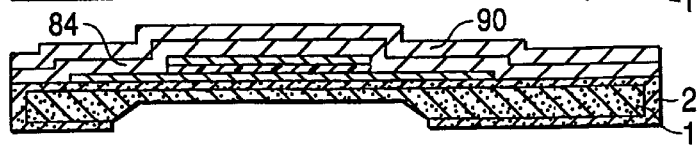
FIG. 14 (11)
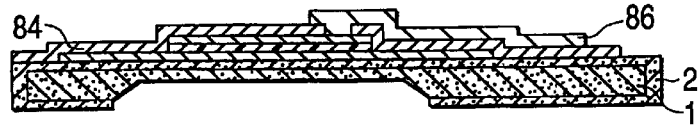
FIG. 14 (12)
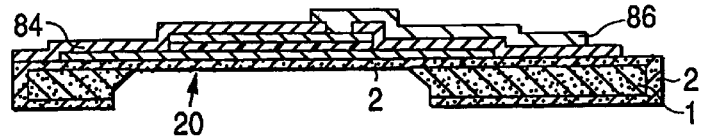

FIG. 15 (1)
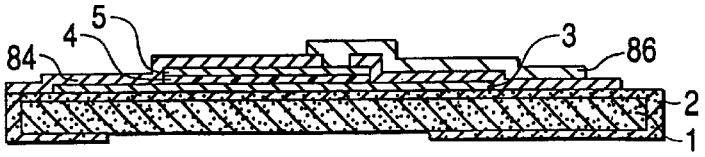
FIG. 15 (2)
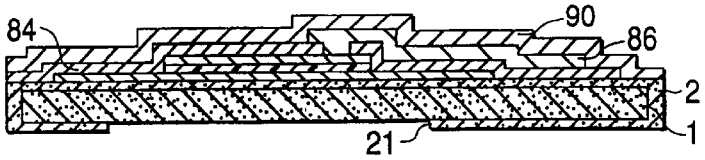
FIG. 15 (3)
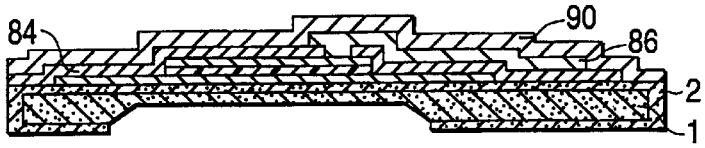
FIG. 15 (4)
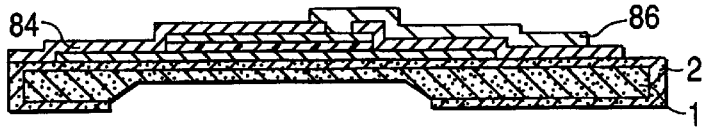
FIG. 15 (5)
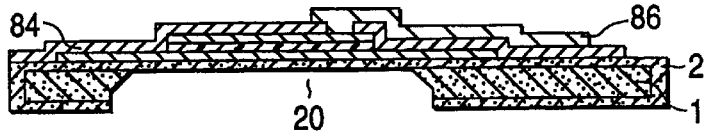
FIG. 15 (6)
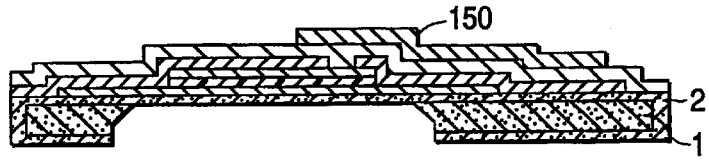
FIG. 15 (7)
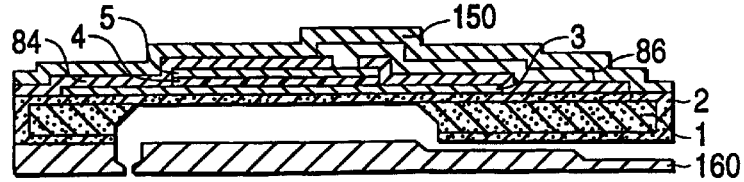

INK JET PRINT HEAD FORMED THROUGH ANISOTROPIC WET AND DRY ETCHING

BACKGROUND OF THE INVENTION

The present invention relates to an ink jet print head and a method of manufacturing the same, and more particularly to an ink jet print head which uses piezoelectric elements as drive sources for drop generators for generating and discharging ink drops and a method of manufacturing the same.

There is known an ink jet print head which uses elements made of lead zirconate titanate (PZT) piezoelectric material (referred to as PZT element) for the drive sources for ink drop ejecting generators for generating ink drops or droplets, i.e., the elements for transducing electric energy into mechanical energy. The ink jet print head is generally formed with a head base, a vibrating plate, and PZT elements. A number of ink passages (ink cavities and the like) are formed in the head base. The vibrating plate is formed over the head base while covering all the ink passages formed therein. The PZT elements are formed on the regions on the vibrating plate, which correspond in position to the ink cavities. In operation, electric fields are selectively applied to the PZT elements, to thereby cause flexural displacements in these elements. With the displacements, inks contained in the ink passages associated with the PZT elements placed under the applied electric fields are forcibly shot forth in the form of ink drops or droplets, through the related ink discharge orifices formed in the nozzle plate.

In a case where the head base is formed of a single-crystal silicon substrate, the single-crystal silicon substrate is selectively subjected to wet etching process to form discrete ink passages in the substrate. This wet etching process is generally carried out using an alkaline aqueous solution of high concentration, e.g., a 5 wt % to 40 wt % potassium hydroxide solution.

For the formation of the nozzle plate, a thin plate (e.g., a stainless plate) having ink discharge orifices formed at predetermined determined positions is bonded onto the head base.

In the ink jet print head thus structured, in forming the head base by wet etching process, if the etching solution comes in contact with the PZT elements, the elements are frequently stripped off or damaged. Specifically, if the single-crystal silicon substrate is etched by use of, for example, an alkaline aqueous solution for an etching solution and the etching progresses to reach the vibrating plate, the alkaline solution or the etching reaction products pass through the vibrating plate to possibly damage the PZT elements, at the termination of the etching.

Meanwhile, the nozzle plate forming method in which a thin plate (e.g., a stainless plate) having ink discharge orifices formed at predetermined determined positions is bonded on the head base, requires complicated manufacturing process. Therefore, this method is not suitable for the mass production of ink jet print heads.

SUMMARY OF THE INVENTION

Accordingly, the present invention is made to solve the above problems, and has an object to provide an ink jet print head which has reliable piezoelectric elements such as a PZT element and is capable of ejecting a large amount of ink at high ejecting speed. Another object of the invention is to provide an ink jet print head which has reliable piezoelectric elements and is capable of ejecting a small amount of ink at high ejecting speed. Yet another object of the invention is to provide a method of manufacturing an ink jet print head which is capable of ejecting a large amount of ink at high ejecting speed without adversely affecting the piezoelectric elements of the print head. Still another object of the invention is to provide a method of manufacturing an ink jet print head which can form the nozzle plate of the head in a simple manner and is suitable for the mass production of the print heads.

An additional object of the present invention is to provide a method of manufacturing an ink jet print head having reliable piezoelectric elements in which wet etching process, which may adversely affect the piezoelectric elements, is carried out at the best timing in the manufacturing of the heads.

According to one aspect of the invention, there is provided an ink jet print head comprising: piezoelectric elements formed on a first surface of a single-crystal silicon substrate; ink cavities formed in the regions of the single-crystal silicon substrate, the regions corresponding in position to the piezoelectric elements; and a nozzle plate formed on a second surface of the single-crystal silicon substrate, the second surface being opposite to the first surface, and the nozzle plate having discharge orifices through which inks contained in the ink cavities are discharged therefrom; wherein in forming the ink cavities, anisotropical wet etching process is used to form a portion (first portion) of each ink cavity ranging from the second surface of the single-crystal silicon substrate to a position (referred to as a surface-region position) near the first surface, and anisotropical dry etching process is used to form a portion (second portion) of each ink cavity ranging from the surface-region position to the first surface of the single-crystal silicon substrate. In the ink jet print head thus constructed, the reliability of the piezoelectric elements is improved.

In the ink jet print head structured as mentioned above, a side wall (second side wall) of each ink cavity ranging from the surface-region position to the first surface of the single-crystal silicon substrate, is tapered toward the outer side of the ink cavity. This feature of the ink jet print head brings about the following advantages, in addition to the above-mentioned ones. Each piezoelectric element serving also as the vibrating plate may have a large compliance although the compliance of the side wall of each ink cavity is little different from that of the conventional one. Therefore, the piezoelectric element may have large flexural displacements, and the ink drop generator including the piezoelectric element and its associated ink cavity generates a large amount of ink drop and shoots forth the same at high speed.

Further, the second side wall of each ink cavity may be tapered toward the inner side of the ink cavity in the above-mentioned ink jet print head. This feature brings about the following advantage, in addition to the above-mentioned ones. The ink contained in each ink cavity may have a large inertance, and each of the piezoelectric elements may have a small compliance. Therefore, the ink jet print head is capable of discharging a small amount of ink drop at a high speed even if the displacement of the vibrating plate is small. In other words, the print head is capable of printing an image, which is higher in density and definition than that printed by the conventional one.

In the ink jet print head mentioned above, the second surface of the single-crystal silicon substrate may have a face (110), and in the anisotropical wet etching process an alkaline aqueous solution may be used for an etching solution.

Alternatively, the second surface of the single-crystal silicon substrate may have a face (100), and in the anisotropical wet etching process an alkaline aqueous solution may be used for an etching solution. In the present specification, the meaning of the "tapered surface" includes a "curved surface".

The present invention also provides an ink jet print head comprising: piezoelectric elements formed on a first surface of a single-crystal silicon substrate; ink cavities formed in the regions of the single-crystal silicon substrate, the regions corresponding in position to the piezoelectric elements; and a nozzle plate formed on a second surface of the single-crystal silicon substrate, the second surface being opposite to the first surface, and the nozzle plate having discharge orifices through which inks contained in the ink cavities are discharged therefrom; wherein a side wall (second side wall) of each ink cavity ranging from a position (referred to as a surface-region position) near the first surface to the first surface of the single-crystal silicon substrate, is tapered toward the outer side of the ink cavity.

The present invention further provides an ink jet print head comprising: piezoelectric elements formed on a first surface of a single-crystal silicon substrate; ink cavities formed in the regions of the single-crystal silicon substrate, the regions corresponding in position to the piezoelectric elements; and a nozzle plate formed on a second surface of the single-crystal silicon substrate, the second surface being opposite to the first surface, and the nozzle plate having discharge orifices through which inks contained in the ink cavities are discharged therefrom; wherein the second side wall of each ink cavity is tapered toward the inner side of the ink cavity.

According to another aspect of the present invention, there is provided a method of manufacturing an ink jet print head having piezoelectric elements formed on a first surface of a single-crystal silicon substrate, ink cavities formed in the regions of the single-crystal silicon substrate, the regions corresponding in position to the piezoelectric elements, and a nozzle plate formed on a second surface of the single-crystal silicon substrate, the second surface being opposite to the first surface, and the nozzle plate having discharge orifices through which inks contained in the ink cavities are discharged therefrom, the manufacturing method comprising the steps of: forming the piezoelectric elements on the single-crystal silicon substrate; and forming the ink cavities in the regions of the single-crystal silicon substrate, which correspond in position to the piezoelectric elements, in a manner that anisotropical wet etching process and anisotropical dry etching process are successively carried out in this order for the single-crystal silicon substrate in a selective manner. The print head manufacturing method can manufacture an ink jet print head which can eject ink drops at a high speed without giving rise to any trouble in the piezoelectric elements.

Another print head manufacturing method of the present invention comprises the steps of: anisotropically wet etching predetermined regions of the single-crystal silicon substrate to a predetermined depth, the predetermined regions being used for the formation of the ink cavities therein; forming the piezoelectric elements on the regions of the single-crystal silicon substrate, the regions corresponding in position to the ink cavities formed by the anisotropical wet etching process; and anisotropically dry etching the predetermined regions of the single-crystal silicon substrate to thereby form ink cavities therein. In the print head manufacturing method; the single-crystal silicon substrate may be anisotropically wet etched before the piezoelectric elements are formed. Therefore, it never happens that the piezoelectric elements are damaged during the etching process. Further, there is no need of forming a protecting film for protecting the piezoelectric elements against the anisotropical etching process. The result is the improvement of the reliability of the piezoelectric elements and the simplification of the manufacturing process.

In the print head manufacturing method, it is preferable that the anisotropical wet etching process is carried out to form a portion (first portion) of each ink cavity ranging from the second surface of the single-crystal silicon substrate to a position (referred to as a surface-region position) near the first surface, and the anisotropical dry etching process is carried out to form a portion (second portion) of each ink cavity ranging from the surface-region position to the first surface of the single-crystal silicon substrate.

Further, it is preferable that the single-crystal silicon substrate is anisotropically wet etched from the surface of a lattice face (110) of the single-crystal silicon substrate, and an etching solution used for the anisotropical wet etching process is an alkaline aqueous solution.

Alternatively, the single-crystal silicon substrate is anisotropically wet etched from the surface of a lattice face (100) of the single-crystal silicon substrate, and an etching solution used for the anisotropical wet etching process is an alkaline aqueous solution.

The print head manufacturing method may further comprises the steps of: filling the ink cavities with material of which the etching rate is high for a predetermined etching solution; flattening the surfaces of the material filled in the ink cavities, the surfaces being exposed in the second surface of the single-crystal silicon substrate; forming a nozzle-plate forming film on the flattened surface of the material; forming a plural number of holes in the regions of the nozzle-plate forming film, the regions being respectively located on the material filled portions of the single-crystal silicon substrate; removing the material through the plural number of holes of the nozzle-plate forming film; and closing the plural number of holes except perforations to be used as discharge orifices. This feature provides such an advantage that the nozzle plate may be formed in a simple manner, in addition to the above advantages.

The invention provides yet another method of manufacturing an ink jet print head having piezoelectric elements formed on a first surface of a single-crystal silicon substrate, ink cavities formed in the regions of the single-crystal silicon substrate, the regions corresponding in position to the piezoelectric elements, and a nozzle plate formed on a second surface of the single-crystal silicon substrate, the second surface being opposite to the first surface, and the nozzle plate having discharge orifices through which inks contained in the ink cavities are discharged therefrom, the manufacturing method comprising the steps of: forming piezoelectric elements on the single-crystal silicon substrate; forming ink cavities in the regions of the single-crystal silicon substrate, the regions corresponding in position to the piezoelectric elements formed; filling the ink cavities with amorphous silicon of which the etching rate is high for a predetermined etching solution; flattening the surfaces of the amorphous silicon filled in the ink cavities, the surfaces being exposed in the second surface of the single-crystal silicon substrate; forming a nozzle-plate forming film on the flattened surface of the amorphous silicon; forming a plural number of holes in the regions of the nozzle-plate forming film, the regions being respectively located on the amorphous silicon filled portions of the single-crystal silicon substrate; removing the amorphous silicon through the plural number of holes of the nozzle-plate forming film; and closing the plural number of holes except perforations to be used as discharge orifices.

Further, the present invention provides a method of manufacturing an ink jet print head in which the timing to carry out the anisotropical wet etching process is set at the best timing in manufacturing the piezoelectric elements.

BRIEF DESCRIPTION OF THE DRAWINGS

FIGS. 2(1) to 2(6) are cross sectional views showing a process of manufacturing the ink jet print head of FIG. 1.

FIGS. 7(1) to 7(3) are cross sectional views useful in explaining the method of manufacturing the ink jet print head which is an embodiment 4 of the invention.

FIGS. 8(1) to 8(12) are cross sectional views showing a method of manufacturing an ink jet print head, which is an embodiment 5 according to the present invention.

FIGS. 9(1) to 9(6) are cross sectional views showing a method of manufacturing an ink jet print head, which is an embodiment 6 according to the present invention.

FIGS. 10(1) to 10(6) are cross sectional views showing a method of manufacturing an ink jet print head, which is an embodiment 7 according to the present invention.

FIGS. 11(1) to 11(3) are cross sectional views showing a method of manufacturing an ink jet print head, which is an embodiment 8 according to the present invention.

FIGS. 12(1) to 12(8) are cross sectional views showing a method of manufacturing an ink jet print head, which is an embodiment 9 according to the present invention.

FIGS. 13(1) to 13(10) are cross sectional views showing a method of manufacturing an ink jet print head, which is an embodiment 10 according to the present invention.

FIGS. 14(1) to 14(12) are cross sectional views showing a method of manufacturing an ink jet print head, which is an embodiment 11 according to the present invention.

FIGS. 15(1) to 15(7) are cross sectional views showing a method of manufacturing an ink jet print head, which is an embodiment 12 according to the present invention.

DETAILED DESCRIPTION OF THE INVENTION

An ink jet print head which is an embodiment of the present invention will be described with reference to the accompanying drawings.

(Embodiment 1)

Figure 1:
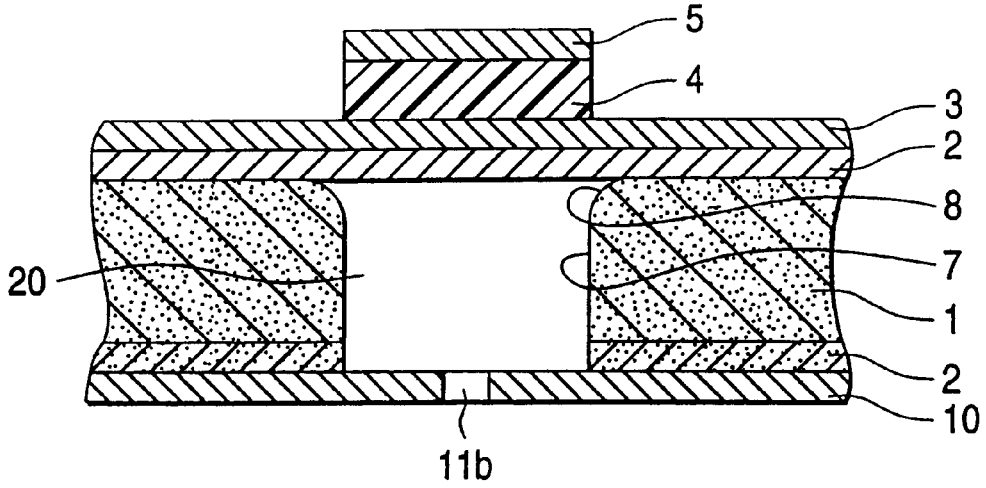
FIG. 1 is a cross sectional view showing a part of an ink jet print head which is an embodiment 1 of the present invention.

FIG. 1 is a cross sectional view showing a part of an ink jet print head which is an embodiment 1 of the present invention. FIG. 2 is a cross sectional view showing a process of manufacturing the ink jet print head of FIG. 1.

The ink jet print head of the embodiment 1, as shown in FIG. 1, a silicon oxide film 2, which will be used as a vibrating plate, is formed over the first surface of a single-crystal silicon substrate 1, and a platinum film 3, which will serve as a vibrating plate and a lower electrode, is formed over the silicon oxide film 2. A piezoelectric (PZT) film 4 is formed on each of predetermined regions (piezoelectric element forming regions) on the platinum film 3. A platinum film 5 to be used as an upper electrode is formed on the PZT film 4. Ink cavities 20 are formed in predetermined regions of the single-crystal silicon substrate 1. Those regions of the substrate are each located under the combination of the PZT film 4 and the platinum film 5. A nozzle plate 10 is formed on the second surface of the single-crystal silicon substrate 1, which is opposite to the first surface. Discharge orifices 11*b* are formed at positions of the second surface, which correspond to the cavities in the single-crystal silicon substrate 1. Ink contained in each cavity is discharged through the discharge orifice associated therewith.

Wall of each ink cavity is substantially normal to the major surfaces of the single-crystal silicon substrate. The cavities with the substantially vertical walls are formed by wet etching process using an alkaline aqueous solution. To make an easy etching, the single-crystal silicon substrate 1 has a face (110) or (100). Incidentally, the present invention is operable if it takes either of the lattice faces.

In forming the ink cavities 20, anisotropical wet etching process is used to form a portion (first portion) of each ink cavity ranging from the second surface of the single-crystal silicon substrate 1 to a position (referred to as a surface-region position) near the first surface, and this portion of each ink cavity 20 is defined by a side wall (first side wall) 7 which is substantially normal to the first surface of the single-crystal silicon substrate. Anisotropical dry etching process is used to form a portion (second portion) of each ink cavity ranging from the surface-region position to the first surface of the single-crystal silicon substrate. This second portion is defined by a side wall (second side wall) 8 tapered toward the outer side of the ink cavity 20.

The thus structured ink jet print head has the following advantageous features. Compliances of the first and second side walls 7 and 8 of each ink cavity 20 are nearly equal to that in the conventional ink jet print head. The silicon oxide film 2 and the platinum film 3 may have large compliances. Because of this, the vibrating plates may have large flexural displacements. Therefore, ink that is contained in the ink cavity 20 and discharged therefrom is large in amount and high in ink discharging speed. The tapered structure of the second side wall 8 contributes to the preventing of the development of a strain in the single-crystal silicon substrate 1. Since the second portion of the ink cavity 20, which ranges from the surface-region position to the first surface of the single-crystal silicon substrate, is formed by anisotropical dry etching process, there is no chance of damaging the PZT film 4 and the platinum film 3 by the etching solution and the etching reaction products just before the etching terminates. This feature contributes to improvements of the reliability of the resultant print head.

A method of manufacturing the ink jet print head structured as shown in FIG. 1 will be described with reference to FIGS. 2(1) to 2(6).

In a process shown in FIG. 2(1), a silicon oxide film 2 is formed to a thickness of about 1.0 to 2.0 $\mu$m over the entire surface of a single-crystal silicon substrate 1 of 200 $\mu$m, for example. A platinum film 3 is formed to a thickness of about 0.2 to 1.0 $\mu$m on the silicon oxide film 2, which is already formed on first or upper (when viewed in the drawing)

surface of the single-crystal silicon substrate 1, by a sputtering method. PZT films 4 are formed, about 0.5 to 5.0 μm thick, on the platinum film 3 by a sol-gel method or a sputtering method. Platinum films 5 are formed, about 0.05 to 0.2 μm thick, on the PZT films 4 by a sputtering method. Thereafter, a resist film (not shown) are formed on the piezoelectric element forming regions on the platinum film 5. The resist film is as a mask in etching process.

In a process shown in FIG. 2(2), a resist film 6 is formed on the regions except the PZT films 4 on the silicon oxide film 2, which was formed on the second surface of the single-crystal silicon substrate 1 in the process of FIG. 2(1), the second surface being opposite to the first surface. The silicon oxide film 2 formed on the second surface of the single-crystal silicon substrate 1 is wet etched using the resist film 6 as a mask.

In a process shown in FIG. 2(3), the resist film 6, which was formed in the process of FIG. 2(2), is stripped off from the oxide film, and the single-crystal silicon substrate 1 is anisotropically etched by use of a mask of the patterned silicon oxide film 2. In the anisotropical wet etching process, the silicon oxide film 2 is first etched away by using a hydrofluoric acid solution for the etching solution, and then the single-crystal silicon substrate 1 is etched by use of potassium hydroxide (KOH) as a solute in the etching solution. In the present embodiment, the single-crystal silicon substrate 1 was etched to a depth of about 180 to 190 μm. By the process, first side walls 7, substantially normal to the first surface of the single-crystal silicon substrate 1, are formed in the regions, which are to be used as ink cavities 20, of the single-crystal silicon substrate.

In a process shown in FIG. 2(4), the single-crystal silicon substrate 1 is further etched by anisotropical dry etching process in lieu of the anisotropical wet etching process used in the process of FIG. 2(3). In the anisotropical dry etching process, an etching gas is a sulfur hexafluoride gas, an organic gas containing fluorine elements, or a mixture gas containing sulfur hexafluoride and an organic material containing fluorine elements. After the etching, a reaction pressure or a mixture ratio of the mixture gas is properly adjusted so as to taper the second side walls of the ink cavities 20 as intended. The anisotropical dry etching process is continued till the silicon oxide film 2 is exposed under the conditions that the substrate temperature is room temperature, and the application of a high frequency output power of 100 W to 2000 W is continued for 5 to 30 minutes. As the result of the anisotropical dry etching process, the second side walls 8, while being tapered toward the outer side of the ink cavities 20, are each formed between the first side wall 7 of the ink cavity 20 and the silicon oxide film 2 formed on the first surface of the single-crystal silicon substrate 1.

Through the FIGS. 2(3) and 2(4) processes, the ink cavities 20 are formed in the single-crystal silicon substrate 1. It is noted here that in the present embodiment, the cavities 20 are formed by the combination of the anisotropical wet etching process and the anisotropical dry etching process. Therefore, it never happens that the platinum films 3 and the PZT films 4 are damaged by the etching solution and the etching reaction products during the etching process.

In a process of FIG. 2(5), the cavities 20 are filled with amorphous silicon 9 by a plasma CVD method. The silicon oxide film 2, which is formed on the second surface of the single-crystal silicon substrate 1, and the portions of the amorphous silicon 9 are flattened. A metal plate 10 of approximately 1.0 to 5.0 μm thick, which is to be used as a nozzle plate, is formed on the flattened silicon oxide film 2 and the portions of the amorphous silicon 9 by a sputtering method. In the embodiment, the metal plate 10 is made of nickel. The portions of the nozzle plate 10, which lie on the portions of the amorphous silicon 9, are selectively etched away to form holes 11*a* to 11*c*. Those holes are formed so as to include holes to be used as discharge orifices.

In a process of FIG. 2(6), the materials of the amorphous silicon 9 are removed from the cavities through the holes 11*a* to 11*c*, formed in the process of FIG. 2(5), by etching process. Gas containing fluorine is used for the etching. Of those holes 11*a* to 11*c*, the holes 11*a* and 11*c* except the holes 11*b* to be used as discharge orifices are closed after the etching operation. Thereafter, the structure is subjected to a necessary process, whereby an ink jet print head having a structure shown in FIG. 1 is completed.

In the present embodiment, the thickness of the single-crystal silicon substrate 1 is selected to be about 200 μm. It is evident, however, that the substrate thickness may be properly selected depending on, for example, the size of an ink jet print head to be manufactured. The same thing is true for the thickness of the silicon oxide film 2, lower electrode films 3 and 5, PZT film 4, and nozzle plate.

While in the above-mentioned embodiment, the single-crystal silicon substrate 1 is anisotropically wet etched to a depth of about 180 to 190 μm. It suffices that the depth of the etching is selected to such an extent as to ensure a smooth discharge of air bubbles developed in the ink contained in each cavity of the manufactured ink jet print head.

The lower electrode film, which is made of platinum in the embodiment, may be made of iridium, palladium, or an allow of iridium and palladium, or may be a conductive layered film consisting of an iridium film and a palladium film. The upper electrode film, which is made of platinum, may also be made of any of aluminum, an alloy of aluminum, copper and silicon, chrome, and tungsten, or may be a conductive film, e.g., an indium-tin oxide film.

The nozzle plate 10 forming the nozzle plate, which is made of nickel, may be made of duralumin, stainless or the like. The metal plate, which is made of zirconia in the embodiment, may be made of ceramic or may be a silicon wafer with a thermal oxide film.

The ink cavities 20, which are filled with amorphous silicon 9 in the embodiment, may be filled with single crystal silicon, a silicon oxide film, not containing impurities, formed by thermal oxidizing process, or another suitable material whose etching rate is high in a given etching solution for nozzle plate, device protecting film and the like. Specifically, if the etching solution is a hydrofluoric acid solution, the cavities may be filled with PSG (silicon oxide film containing phosphorus) or a silicon oxide film formed by a CVD method. If the etching solution is xylene, the ink cavities may be filled with nega resist. If it is acetone, the cavities may be filled with posi resist.

It is evident that the process steps FIGS. 2(5) to 2(6), or the nozzle plate manufacturing process, in the embodiment may be applied to the head base with the ink cavities which have another structure or a conventional one.

(Embodiment 2)

An ink jet print head which is an embodiment 2 of the present invention will be described with reference to FIGS. 3 and 4. In those figures, like reference numerals are used for designating like or equivalent portions in FIGS. 1 and 2, which are used for explaining the embodiment 1.

Figure 3:
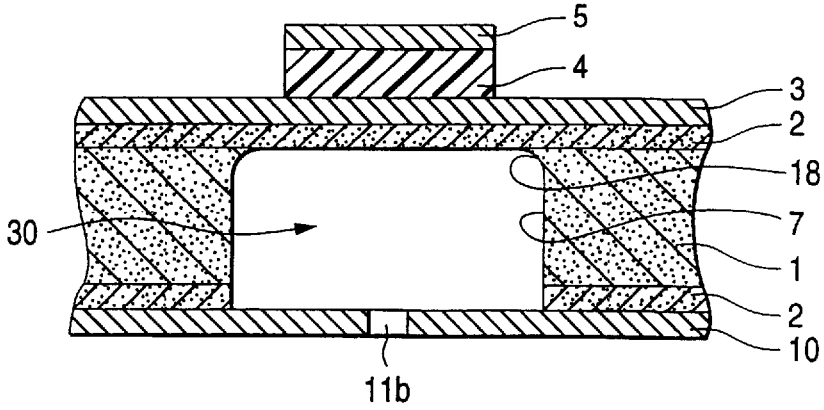
FIG. 3 is a cross sectional view showing a part of an ink jet print head which is an embodiment 2 of the present invention.

FIG. 3 is a cross sectional view showing a part of the ink jet print head which is the embodiment 2 of the present invention. FIG. 4 is a cross sectional view showing a process of manufacturing the ink jet print head of FIG. 3.

The structure difference between the ink jet print heads of the embodiments 1 and 2 (FIGS. 1 and 3) resides in the side wall structure of each ink cavity. In forming the ink cavities 30 of the ink jet print head of this embodiment, anisotropical wet etching process is used to form a portion (first portion) ranging from the second surface of the single-crystal silicon substrate 1 to a position (referred to as a surface-region position) near the first surface, and this portion of each ink cavity 30 is defined by a side wall (first side wall) 7 which is substantially normal to the first surface of the single-crystal silicon substrate. Anisotropical dry etching process is used to form a portion (second portion) ranging from the surface-region position to the first surface of the single-crystal silicon substrate 1. This second portion is defined by a side wall (second side wall) 18 tapered toward the inner side of the ink cavity 30.

In the ink jet print head thus structured, an inertance of ink contained in each of the ink cavities 30 may have a large inertance, and the silicon oxide film 2 and the platinum film 3 may have small compliances. Therefore, the ink jet print head is capable of discharging a small amount of ink at a high speed. In other words, the print head is capable of printing an image, which is higher in density and definition than that printed by the conventional one. The print head of this embodiment is able to discharge an ink drop, although the flexural displacement of each PZT film 4 is small. Since the second portion of the ink cavity 30, which ranges from the surface-region position to the first surface of the single-crystal silicon substrate, is formed by anisotropical dry etching process, there is no chance of the damage of the PZT film 4 and the platinum film 3 by the etching solution and the etching reaction products when the cavities 30 are etched. This feature contributes to improvements of the reliability of the resultant print head.

A method of manufacturing the ink jet print head shown in FIG. 3 will be described with reference to FIG. 4. For the description of the same processes as of the embodiment 1, reference will be made to FIG. 2.

Figure 4:
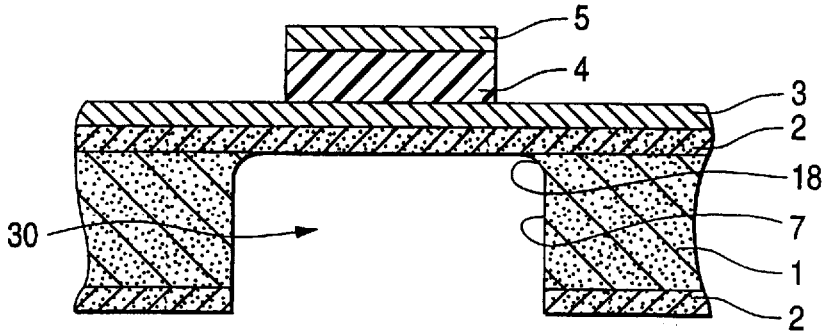
FIG. 4 is a cross sectional view showing a process of manufacturing the ink jet print head of FIG. 3.

The process shown in FIG. 4 is carried out following the processes of FIGS. 2(1) to 2(3).

In the process shown in FIG. 4, the anisotropical wet etching process used in the process of FIG. 2(3) is switched to an anisotropical dry etching process, and the single-crystal silicon substrate 1 is etched by the anisotropical dry etching process. In the anisotropical dry etching process, an etching gas is a sulfur hexafluoride gas, an organic gas containing fluorine elements, or a mixture gas containing sulfur hexafluoride and an organic material containing fluorine elements. After the etching, a reaction pressure or a mixture ratio of the mixture gas is properly adjusted so as to taper the second side walls of the ink cavities 30 as intended. The anisotropical dry etching process is continued till the silicon oxide film 2 is exposed, under the conditions that the substrate temperature is room temperature, and the application of a high frequency output power of 100 W to 2000 W is continued for 5 to 30 minutes. As the result of the anisotropical dry etching process, the second side walls 18, while being tapered toward the inner side of the ink cavities 20, are each formed between the first side wall 7 of the ink cavity 30 and the silicon oxide film 2 formed on the first surface of the single-crystal silicon substrate 1.

Through the FIGS. 2(1) and 2(3), and FIG. 4 processes, the ink cavities 30 are formed in the single-crystal silicon substrate 1. It is noted here that in the present embodiment, the cavities 30 are formed by the combination of the anisotropical wet etching process and the anisotropical dry etching process. Therefore, it never happens that the platinum films 3 and the PZT films 4 are corroded by the etching solution and the etching reaction products produced during the etching process.

Thereafter, processes similar to those shown in FIGS. 2(5) to 2(6) are successively carried out, and an ink jet print head having a structure shown in FIG. 3 is completed.

(Embodiment 3)

An ink jet print head which is an embodiment 3 of the present invention will be described with reference to FIGS. 5 and 6. In those figures, like reference numerals are used for designating like or equivalent portions in FIGS. 1 and 2, which are used for explaining the embodiment 1.

Figure 5:
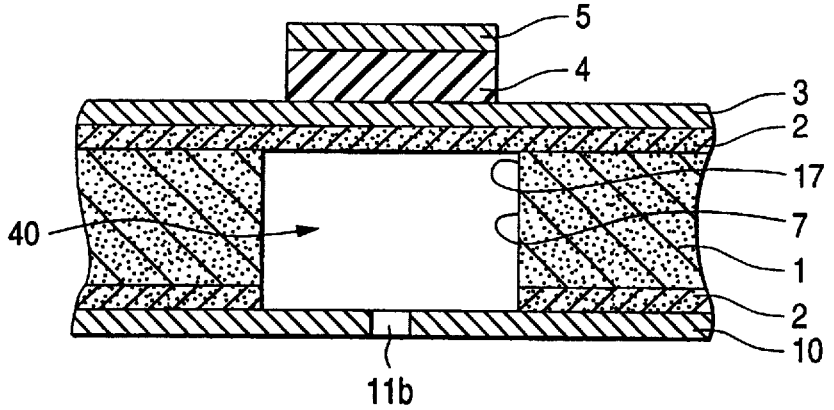
FIG. 5 is a cross sectional view showing a part of an ink jet print head which is an embodiment 3 of the present invention.

FIG. 5 is a cross sectional view showing a part of the ink jet print head which is the embodiment 3 of the present invention. FIG. 6 is a cross sectional view showing a process of manufacturing the ink jet print head of FIG. 5.

The structure difference between the ink jet print heads of the embodiments 1 and 3 (FIGS. 1 and 5) resides in the side wall structure of each ink cavity. In forming the ink cavities 40 of the ink jet print head of this embodiment, anisotropical wet etching process is used to form a portion (first portion) ranging from the second surface of the single-crystal silicon substrate 1 to a position (referred to as a surface-region position) near the first surface, and this portion of each ink cavity 40 is defined by a side wall (first side wall) 7 which is substantially normal to the first surface of the single-crystal silicon substrate. Anisotropical dry etching process is used to form a portion (second portion) ranging from the surface-region position to the first surface of the single-crystal silicon substrate 1. This second portion is defined by a side wall (second side wall) 17 which is also substantially normal to the first surface of the single-crystal silicon substrate.

Since the second portion of the ink cavity 40, which ranges from the surface-region position to the first surface of the single-crystal silicon substrate, is formed by anisotropical dry etching process, there is no chance of the damage of the PZT film 4 and the platinum film 3 by the etching solution and the etching reaction products when the cavities 40 are etched. This feature contributes to improvements of the reliability of the resultant print head.

A method of manufacturing the ink jet print head shown in FIG. 5 will be described with reference to FIG. 6. For the description of the same processes as of the embodiment 1, reference will be made to FIG. 2.

Figure 6:
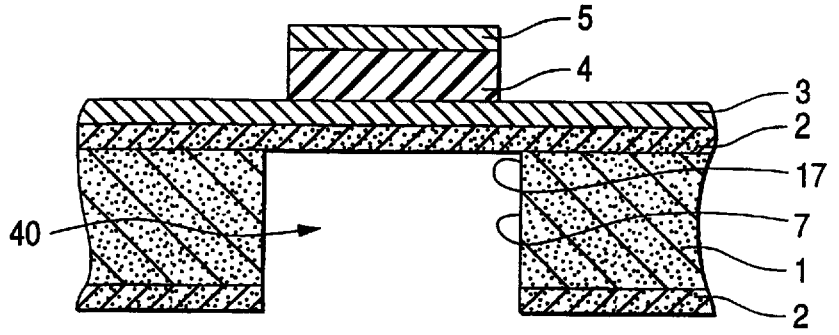
FIG. 6 is a cross sectional view showing a process of manufacturing the ink jet print head of FIG. 5.

The process shown in FIG. 6 is carried out following the processes of FIGS. 2(1) to 2(3).

In the process shown in FIG. 6, the anisotropical wet etching process used in the process of FIG. 2(3) is switched to an anisotropical dry etching process, and the single-crystal silicon substrate 1 is etched by the anisotropical dry etching process. In the anisotropical dry etching process, an etching gas is a sulfur hexafluoride gas, an organic gas containing fluorine elements, or a mixture gas containing sulfur hexafluoride and an organic material containing fluorine elements. After the etching, a reaction pressure or a mixture ratio of the mixture gas is properly adjusted so as to shape the second side walls of the ink cavities 40 as intended. The anisotropical dry etching process is continued till the silicon oxide film 2 is exposed, under the conditions that the substrate temperature is room temperature, and the application of a high frequency output power of 100 W to 2000 W is continued for 5 to 30 minutes. As the result of the anisotropical dry etching process, the second side walls 17 are each formed between the first side wall 7 of the ink cavity 40 and the silicon oxide film 2 formed on the first surface of the single-crystal silicon substrate 1. The side walls 17 are also substantially normal to the first surface of the single-crystal silicon substrate, like the first side walls 7.

Through the FIGS. 2(1) and 2(3), and FIG. 6 processes, the ink cavities 40 are formed in the single-crystal silicon substrate 1. It is noted here that in the present embodiment, the cavities 40 are formed by the combination of the anisotropical wet etching process and the anisotropical dry etching process. Therefore, it never happens that the platinum films 3 and the PZT films 4 are corroded by the etching solution and the etching reaction products produced during the etching process.

Thereafter, processes similar to those shown in FIGS. 2(5) to 2(6) are successively carried out, and an ink jet print head having a structure shown in FIG. 5 is completed.

(Embodiment 4)

A method of manufacturing an ink jet print head which is an embodiment 4 of the present invention will be described with reference to FIG. 7.

In the present embodiment, the ink jet print head of the embodiment 1 is manufactured by another manufacturing method. Detailed description of processes similar to those used in the embodiment 1 will be omitted.

FIGS. 7(1) to 7(3) are cross sectional views useful in explaining the method of manufacturing the ink jet print head which is the embodiment 4 of the invention.

In the process shown in FIG. 7(1), a silicon oxide film 2 is formed over the entire surface of a single-crystal silicon substrate 1 as in the embodiment 1. A resist film 6 is formed on the regions of the silicon oxide film 2 except the regions to be used for the cavities 20 on the second surface of the single-crystal silicon substrate 1. The silicon oxide film 2 is wet etched using the resist film 6 as a mask.

In a process of FIG. 7(2), the resist film 6 is stripped off from the oxide film, and then the single-crystal silicon substrate 1 is anisotropically etched under conditions similar to those in the embodiment 1, while using the silicon oxide film 2 as a mask. In this way, the side walls 7 are formed in the regions to be formed as cavities 20 in the single-crystal silicon substrate 1. The side walls 7 are substantially normal to the first surface of the single-crystal silicon substrate.

The anisotropical wet etching of the single-crystal silicon substrate 1 is carried out in a state that the piezoelectric elements are not yet formed on the structure. Therefore, it never happens that the piezoelectric elements are damaged during the anisotropical wet etching process. Further, there is no need of forming a protecting film for protecting the piezoelectric elements against the anisotropical wet etching. The result is the improvement of the reliability of the piezoelectric elements and the simplification of the manufacturing process.

Piezoelectric elements each consisting of a platinum film 3, PZT film 4 and platinum film 5 are formed on the silicon oxide film 2 of the first surface of the single-crystal silicon substrate 1 in similar conditions to those in the embodiment 1.

In the process of FIG. 7(3), the single-crystal silicon substrate 1 is anisotropically dry etched in similar conditions to those in the embodiment 1. By the anisotropical etching process, the single-crystal silicon substrate 1 is further etched deeper than a position where the anisotropical wet etching process stops (FIG. 7(2)). As a result, second side walls 8 are formed while tapered to the outer side of the cavities 20.

Thereafter, the processes of FIGS. 2(5) and 2(6) used in the embodiment 1 are carried out, whereby an ink jet print head having a structure shown in FIG. 1 is produced.

(Embodiment 5)

A method of manufacturing an ink jet print head which an embodiment 5 of the present invention will be described with reference to FIGS. 8(1) to 8(12). Cross sectional views which will be referred to in the descriptions of the subsequent embodiments of the invention are taken along a plane vertical to the paper surface of the drawing.

A process shown in FIGS. 8(1) to 8(12) is a modification of the process of FIGS. 7(1) to 7(3). In a step of FIG. 8(1), a silicon oxide film 2 is formed on the entire surface of a single-crystal silicon substrate 1. In a step of FIG. 8(2), the silicon oxide film 2 formed on the second or lower (when viewed in the drawing) surface of the single-crystal silicon substrate 1 is patterned to form openings 21. In a step of FIG. 8(3), the single-crystal silicon substrate or silicon wafer 1 is anisotropically wet etched through the wet etching openings 21 of the silicon dioxide film on the second surface of the silicon wafer, whereby the silicon wafer is half etched in preparation for the formation of cavities 20.

In a step of FIG. 8(4), a lower electrode film 3, a PZT film 4 and an upper electrode film 5 are layered on the first surface of the single-crystal silicon substrate 1 successively. In a step of FIG. 8(5), a resist film 80 is selectively formed on those films successively layered on the first surface of the single-crystal silicon substrate 1 as shown. In a step of FIG. 8(6), the upper electrode film 5 and the PZT film 4 are etched by use of a mask of the resist film 80.

In a step of FIG. 8(7), the resist film 80 is stripped off, and in a step of FIG. 8(8), a resist mask 82 used for forming the lower electrodes is formed, and in a step of FIG. 8(9), the lower electrode film is etched to be patterned by use of a mask of the resist mask 82.

In a step of FIG. 8(10), the resist mask 82 is stripped off, and in a step of FIG. 8(11) an interlayer insulating film 84 is formed and wires 86 are formed connecting to the upper electrodes. In a step of FIG. 8(12), the single crystal silicon left in the cavities 20 is etched till the silicon oxide film 2 that is formed on the elements-formed side or the first surface of the silicon substrate, by anisotropical dry etching process. Through the above steps of the modification of the FIG. 7 process, the fabrication of an ink jet print head is completed.

In the sequence of process steps, the silicon oxide film is formed, the wet etching process is carried out, and finally the dry etching process is carried out. Since a strong alkaline aqueous solution of KOH, for example, is used for the anisotropical wet etching process, it is necessary, originally, to form an alkali resistance protecting film on the elements forming surface of the single-crystal silicon substrate. In this respect, it is noted that in the process of the embodiment, the wet etching is carried out in a stage where the PZT films are not yet formed. For this reason, there is no need for the formation of the protecting film, and the resultant actuators and ink jet print heads are reliable and fabricated in a simple manner.

(Embodiment 6)

A method of manufacturing an ink jet print head which an embodiment 6 of the present invention will be described with reference to FIGS. 9(1) to 9(6). In a step of FIG. 9(1), a silicon oxide film 2 is formed over the entire surface of a single-crystal silicon substrate 1. In a step of FIG. 9(2), a lower electrode film 3 is formed over the first surface of the single-crystal silicon substrate 1. Further, openings are formed in the silicon oxide film 2 that is formed on the second surface of the single-crystal silicon substrate.

In a step of FIG. 9(3), a wet etching protecting film 90 is formed over the lower electrode film 3. In a step of FIG.

9(4), the silicon wafer is half etched from the second surface of the single-crystal silicon substrate by anisotropical wet etching process. In a step of FIG. 9(5), the wet etching protecting film 90 is removed. In a step of FIG. 9(6), a PZT film 4 and an upper electrode film 5 are formed. The subsequent process steps are equal to the step of FIG. 7(5) and subsequent ones.

In the present embodiment, the lower electrode film 3 is formed, the silicon wafer is half etched by anisotropical wet etching process, and in the final step of the wafer process the dry etching is carried out. It is noted that the wet etching is carried out in a stage where the piezoelectric thin film is not yet formed. Therefore, even if the etching resistance of the wet etching protecting film 90 is imperfect, for example, the film 90 suffers from pin holes, the lower electrodes are not damaged since the lower electrode film 3 is made of platinum Pt or iridium Ir. If required, the wet etching protecting film 90 is omissible. Thus, the manufacturing method of the embodiment 6 can manufacture reliable actuators and ink jet print heads in a simple manner.

In the manufacturing process of the embodiment, when the silicon oxide films on the first and second surfaces of the single-crystal silicon substrate 1 are etched in the step of FIG. 9(2), the silicon oxide film on the first surface of the silicon substrate is protected by the lower electrode film 3. Therefore, there is a less chance that the thickness of the silicon oxide film is reduced. The result is to minimize a variation of the vibrating characteristic of the silicon oxide film as a vibrating plate.

(Embodiment 7)

An embodiment 7 of the present invention which is a method of manufacturing an ink jet print head will be described with reference to FIGS. 10(1) to 10(6). In a step of FIG. 10(1), a silicon oxide film 2 is formed over the entire surface of a single-crystal silicon substrate 1. In a step of FIG. 10(2), a lower electrode film 3 and a PZT film 4 are formed in this order on the silicon oxide film 2. In a step of FIG. 10(3), openings 21 are formed in the silicon oxide film 2, which is formed on the second surface of the single-crystal silicon substrate 1.

In a step of FIG. 10(4), a protecting film 90 is formed over the PZT film 4. In a step of FIG. 10(5), the single-crystal silicon substrate 1 is half etched from its second surface. In a step of FIG. 10(6), the protecting film 90 is stripped off. An upper electrode film 5 is formed on the PZT film 4, and the subsequent steps are equal to the step of FIG. 8(5) and the subsequent ones.

In the FIG. 10 process, the piezoelectric thin film 4 is formed, the silicon wafer is half etched (to a depth of the half thickness of the etched layer, i.e., the silicon wafer) by wet etching process, and finally dry etching process is carried out. In the process, the wet etching process is carried out before the elements-forming side or the first surface of the single-crystal silicon substrate undergoes photolithgraphy process yet. In the stage of carrying out the etching process, the silicon wafer is not stained with foreign materials, and hence the etching protecting film 90 does not suffer from defects, e.g., pin holes. Therefore, the print head manufacturing method of the embodiment 7 can form ink cavities without damaging the piezoelectric thin film.

(Embodiment 8)

An embodiment 8 of the invention which is a method of manufacturing an ink jet print head, will be described with reference to FIGS. 11(1) to 11(3). In a step of FIG. 11(1), a silicon oxide film 2 is formed over the entire surface of a silicon wafer 1, and then a lower electrode film 3, a PZT film 4 and an upper electrode film 5 are successively layered on the silicon oxide film 2. In a step of FIG. 11(2), the silicon oxide film 2 on the second surface of the silicon wafer is opened to form openings 21. In a step of FIG. 11(3), the silicon wafer is half etched through the openings 21 of the silicon oxide film. The subsequent steps are equal to the step of FIG. 8(5) and the subsequent ones.

In the sequence of the process steps, after the upper electrode film 5 is formed, the silicon wafer is half etched by wet etching process, and finally the dry etching is carried out. In this process, the upper electrode film, because of its noble metal such as Pt and Ir, serves as a protecting film to prevent the PZT film from being damaged.

(Embodiment 9)

An embodiment 9 of the present invention will be described with reference to FIGS. 12(1) to 12(8). In a step of FIG. 12(1), a silicon oxide film 2 is formed over the entire surface of a silicon wafer 1, and then a lower electrode film 3, a PZT film 4 and an upper electrode film 5 are successively layered on the silicon oxide film 2. In a step of FIG. 12(2), resist films 80 are formed on the first and second surfaces of the silicon wafer 1.

In a step of FIG. 12(3), the silicon oxide film 2 on the second surface of the silicon substrate 1 is opened to form openings 21. In a step of FIG. 12(4), the upper electrode film 5 and the PZT film 4 are selectively etched away. In a step of FIG. 12(5), the resist films are stripped off from both sides of the silicon substrate 1. In a step of FIG. 12(6), a protecting film 90 is formed on the first surface of the silicon substrate.

In a step of FIG. 12(7), the silicon oxide film 2 on the second surface of the silicon substrate 1 is opened to form openings, and the silicon substrate is half etched by anisotropical wet etching process. In a step of FIG. 12(8), the protecting film 90 is removed. The subsequent process steps are equal to the step of FIG. 8(8) and the following.

In those process steps, after the major portions of the piezoelectric elements are formed, the silicon wafer is etched by wet etching process and then the dry etching is carried out. In the present embodiment, the wet etching is performed before the interlayer insulating film of an organic thin film is formed. Therefore, an organic film may be used for the wet etching protecting film 90. The organic film may be formed by simple process, e.g., spin coating. This leads to simplification of the manufacturing process. Simplified process improves a production yield and realizes the production of highly reliable piezoelectric elements.

(Embodiment 10)

An embodiment 10 of the present invention will be described with reference to FIGS. 13(1) to 13(10). Process steps of FIGS. 13(1) to 13(5) in this embodiment are equal to those in FIGS. 12(1) to 12(5). In a step of FIG. 13(6), a resist film 80 is formed on the lower electrode film 3 in the same pattern as of the lower electrodes. In a step of FIG. 13(7), the lower electrode film 3 is patterned by use of a mask of the resist film 80. In a step of FIG. 13(8), the resist film is removed. In a step of FIG. 13(9), a protecting film 90 is formed over the electrodes-formed side of the silicon substrate, and the silicon substrate is anisotropically wet etched from the openings 21 on the second surface of the silicon substrate. In a step of FIG. 13(10), the wet etching protecting film 90 is removed.

In these steps, the silicon substrate is half etched by wet etching process after the lower electrode film 3 is etched for its patterning. This brings about the following useful effects.

The material of the lower electrodes is noble metal, e.g., platinum Pt or iridium Ir. The etching protecting film is an organic high polymer film of fluorine plastics. The fluorine high polymer film exhibits poor adhesive properties for the Pt or Ir film. Therefore, during the etching process, the etching protecting film is frequently stripped off. In the present embodiment, after the lower electrodes are etched, the silicon oxide film 2 is exposed. With this, the silicon oxide film is put in close contact with the etching protecting film. Therefore, there is no chance of stripping off of the protecting film during the wet etching process. Thus, the manufacturing method of the embodiment is able to manufacture high reliable piezoelectric elements at high production yield.

(Embodiment 11)

An embodiment 11 of the present invention will be described with reference to FIGS. 14(1) to 14(12). Process steps FIGS. 14(1) to 14(7) are equal to those of FIGS. 13(1) to 13(8). In a step of FIG. 14(8), an interlayer insulating film 84 is formed on the elements-formed side or the first surface of the silicon substrate. In a step of FIG. 14(9), an etching protecting film 90 is layered over the interlayer insulating film 84. In a step of FIG. 14(10), the silicon substrate is half etched form the wet etching openings 21 by anisotropical wet etching process.

In a step of FIG. 14(11), the wet etching protecting film is removed and wires connecting to the upper electrodes 5 are formed. In a step of FIG. 14(12), the silicon substrate is etched till the silicon oxide film 2 on the first surface of the silicon substrate is exposed, by anisotropical dry etching process.

In the process of the embodiment, the wet etching is performed after the interlayer insulating film is formed, and finally the dry etching is performed. This unique process has the following useful effects.

The lower electrodes, which are made of noble metal exhibiting poor adhesive properties for the etching protecting film as the fluorine high polymer film, are completely covered with the interlayer insulating film. Therefore, the etching protecting film is layered on the interlayer insulating film while not contact with the lower electrodes. For this reason, there is no chance that the KOH aqueous solution as an etching solution for the wet etching comes in contact with the piezoelectric elements to damage the piezoelectric elements.

(Embodiment 12)

An embodiment 12 of the present invention will be described with reference to FIGS. 15(1) to 15(7). Steps before FIG. 15(1) are equal to the steps of FIGS. 14(1) to 14(8). Hence, those steps are omitted. In the step of FIG. 15(1), wires 86 connecting to the upper electrodes 5 are formed on the interlayer insulating film 84. In a step of FIG. 15(2), a wet etching protecting film 90 is formed over the structure. In a step of FIG. 15(3), the silicon substrate is half etched through the openings of the silicon oxide film 2 by anisotropical wet etching process.

In a step of FIG. 15(4), the wet etching protecting film 90 is removed. In a step of FIG. 15(5), the silicon substrate left within the openings of the silicon oxide film is etched away by anisotropical dry etching process. The step of FIG. 15(4) may be replaced with the step of FIG. 15(5).

An ambience protecting film 150 is formed in a step of FIG. 15(6), and in a step of FIG. 15(7) a nozzle plate 160 is bonded on the cavity-opened side or the second surface of the silicon substrate. Here, an ink jet print head is completed.

In the manufacturing process of the embodiment, the wet etching process follows the wiring process step, and the dry etching process follows the wet etching process. If the protecting film is stripped off after the step of FIG. 15(5), the wet etching process and the dry etching process are successively carried out. Where the silicon wafer is approximately 200 $\mu$m, the depth of the half etching in each cavity (or diaphragm) is approximately 180 $\mu$m. If the silicon wafer being in a half etched state is subjected to film forming processes of various films and photolithgraphy process, it is stained with various foreign materials. Foreign materials, e.g., particles, tend to accumulate in the cavities (or diaphragms) being in a half-etched state. The work of removing the foreign materials from the cavities is difficult.

It noted that in the process of the present embodiment, the wet etching process and the dry etching process may be successively performed. If so done, there is no chance of entering of foreign materials into the cavities (or diaphragms). Therefore, the manufacturing method of the embodiment can produce highly reliable ink jet print heads at high production yield.

As seen from the foregoing description, in an ink jet print head of the present invention, a portion of each ink cavity close to the piezoelectric element associated therewith is formed by anisotropical dry etching process. Therefore, any adverse influence is exerted on the piezoelectric elements during the process of forming the ink cavities. The result is to provide an ink jet print head having reliable piezoelectric elements.

A portion of each ink cavity close to the associated piezoelectric element is tapered to the outer side of the ink cavity. This feature brings about the following useful effect, in addition to the above effect. The silicon oxide film and the lower electrode may have large compliances although the compliance of the side wall of each ink cavity is little different from that of the conventional one. Therefore, the piezoelectric element may have large flexural displacements, and the ink drop generator generates a large amount of ink drop and shoots forth the same at high speed.

A portion of each ink cavity close to the associated piezoelectric element may be tapered to the inner side of the ink cavity. This feature brings about the following useful effect, in addition to the above-mentioned one. The ink contained in each ink cavity may have a large inertance, and the vibrating plate and the lower electrode may have a small compliance. Therefore, the ink jet print head is capable of discharging a small amount of ink drop at a high speed even if the displacement of the vibrating plate is small. In other words, the print head is capable of printing an image, which is higher in density and definition than that printed by the conventional one.

After the single-crystal silicon substrate is anisotropically wet etched, the piezoelectric elements are formed on the single-crystal silicon substrate, and the substrate is anisotropically dry etched. Therefore, it never happens that the piezoelectric elements are damaged by the anisotropical wet etching process, so that the reliability of the piezoelectric elements is improved. Further, there is no need of forming a protecting film for protecting the piezoelectric elements against the anisotropical etching process. Therefore, the manufacturing process is simplified.

In the ink jet print head of the invention, a film for forming a nozzle plate is formed, and discharge orifices are formed in the formed film. Therefore, the formation of the nozzle plate is simple. Further, it allows the ink jet print heads to easily be manufactured in a mass production manner. This leads to reduction of cost to manufacture.

What is claimed is:

1. An ink jet print head comprising:

a single-crystal silicon substrate having a first surface and a second surface opposite to said first surface;

a piezoelectric element disposed on said first surface of said single-crystal silicon substrate;

an ink cavity disposed in a region of said single-crystal silicon substrate, said region corresponding in position to said piezoelectric element; and a nozzle member disposed on said second surface of said single-crystal silicon substrate, said nozzle member having at least an orifice communicating with said ink cavity, wherein said ink cavity includes a first portion ranging from said second surface to a surface-region position near said first surface, said first portion being formed through anisotropical wet etching, and a second portion ranging from said surface-region position to said first surface, said second portion being formed through anisotropical dry etching; and in which a side wall of said ink cavity ranging from said surface-region position to said first surface is tapered toward an outer side of said ink cavity.

2. An ink jet print head according to claim 1, in which said second surface of said single-crystal silicon substrate has a face (110), and said anisotropical wet etching process uses an alkaline aqueous solution as an etching solution.

3. An ink jet print head according to claim 1, in which said second surface of said sirigle-crystal silicon substrate has a face (100), and said anisotropical wet etching process uses an alkaline aqueous solution as an etching solution.

4. An ink jet print head, comprising:

a single-crystal silicon substrate having a first surface and a second surface opposite to said first surface;

a piezoelectric element disposed on said first surface of said single-crystal silicon substrate;

an ink cavity disposed in a region of said single-crystal silicon substrate, said region corresponding in position to said piezoelectric element; and a nozzle member disposed on said second surface of said single-crystal silicon substrate, said nozzle member having at least an orifice communicating with said ink cavity, wherein said ink cavity includes a first portion ranging from said second surface to a surface-region position near said first surface, said first portion being formed through anisotropical wet etching, and a second portion ranging from said surface-region position to said first surface, said second portion being formed through anisotropical dry etching; and in which a side wall of said ink cavity is tapered toward an inner side of said ink cavity.

5. An ink jet print head according to claim 4, in which said second surface of said single-crystal silicon substrate has a face (110), and said anisotropical wet etching process uses an alkaline aqueous solution as an etching solution.

6. An ink jet print head according to claim 4, in which said second surface of said single-crystal silicon substrate has a face (100), and said anisotropical wet etching process uses an alkaline aqueous solution as an etching solution.

7. An ink jet print head, comprising:

a single-crystal silicon substrate having a first surface and a second surface opposite to said first surface;

a piezoelectric element disposed on said first surface of said single-crystal silicon substrate;

an ink cavity disposed in a region of said single-crystal silicon substrate, said region corresponding in position to said piezoelectric element; and a nozzle member disposed on said second surface of said single-crystal silicon substrate, said nozzle member having at least an orifice communicating with said ink cavity, wherein a side wall of said ink cavity ranging from a surface-region position near said first surface to said first surface of said single-crystal silicon substrate, is tapered toward an outer side of said ink cavity.

8. An ink jet print head, comprising:

a single-crystal silicon substrate having a first surface and a second surface opposite to said first surface;

a piezoelectric element disposed on said first surface of said single-crystal silicon substrate;

an ink cavity disposed in a region of said single-crystal silicon substrate, the region corresponding in position to said piezoelectric element; and a nozzle member disposed on said second surface of said single-crystal silicon substrate, said nozzle member having at least an orifice communicating with said ink cavity, wherein a side wall of said ink cavity ranging from a surface-region position near to said first surface to said first surface of said single-crystal silicon substrate, is tapered toward an inner side of said ink cavity.

9. An ink jet print head comprising:

a single-crystal silicon substrate having a first surface and a second surface opposite to said first surface;

a piezoelectric element disposed on said first surface of said single-crystal silicon substrate;

an ink cavity disposed in a region of said single-crystal silicon substrate, said region corresponding in position to said piezoelectric element; and a nozzle member disposed on said second surface of said single-crystal silicon substrate, said nozzle member having at least an orifice communicating with said ink cavity, wherein said ink cavity is formed through anisotropical wet etching and through anisotropical dry etching subsequently conducted after said anisotropical wet etching; and wherein side walls of said ink cavity has a first portion that is linear and a second portion that is curved.

10. An ink jet recording head according to claim 9, in which said second surface of said single-crystal silicon substrate has a face (110), and said anisotropical wet etching process uses an alkaline aqueous solution as an etching solution.

11. An ink jet recording head according to claim 9, in which said second surface of said single-crystal silicon substrate has a face (100), and said anisotropical wet etching process uses an alkaline aqueous solution as an etching solution.

12. An ink jet print head comprising:

a single-crystal silicon substrate having a first surface and a second surface opposite to said first surface;

a piezoelectric element disposed on said first surface of said single-crystal silicon substrate;

an ink cavity disposed in a region of said single-crystal silicon substrate, said region corresponding in position to said piezoelectric element; and a nozzle member disposed on said second surface of said single-crystal silicon substrate, said nozzle member having at least an orifice communicating with said ink cavity, wherein each of at least a pair of side walls of said ink cavity has a first portion which is linear and a second portion which is curved.

13. An ink jet recording head according to claim 12, in which said second portion is curved toward an inner side of said ink cavity.

14. An ink jet recording head according to claim 12, in which said second portion is curved toward an outer side of said ink cavity.

15. An ink jet recording had according to claim 12, in which said second surface of said single-crystal silicon substrate has a face (110).

16. An inkjet recording head according to claim 12, in which said second surface of said single-crystal silicon substrate has a face (100).

* * * * *